United States Patent [19]

Shinkai et al.

[11] Patent Number: 4,821,504

[45] Date of Patent: Apr. 18, 1989

[54] SYSTEM FOR CONTROLLING DISPLACEMENT OF CARRIAGE WORKING MACHINES

[75] Inventors: Kunio Shinkai, Handa; Yutaka Tanaka, Gifu; Hachiro Yokoyama, Nishikasugai, all of Japan

[73] Assignee: Howa Machinery, Ltd., Aichi, Japan

[21] Appl. No.: 236,342

[22] Filed: Aug. 22, 1988

Related U.S. Application Data

[63] Continuation of Ser. No. 67,261, Jun. 25, 1987, abandoned.

[51] Int. Cl.[4] ..... D01H 9/10; D01H 9/14; B65H 67/00

[52] U.S. Cl. ..... 57/276; 57/1 R; 57/264; 57/266; 57/268; 104/91; 242/35.5 A

[58] Field of Search ..... 57/1 R, 261–266, 57/268, 276, 281; 242/35.5 R, 35.5 A; 104/88, 89, 91, 106

[56] References Cited

U.S. PATENT DOCUMENTS

| | | | |
|---|---|---|---|
| 3,828,682 | 8/1974 | Klein | 104/91 |
| 4,041,686 | 8/1977 | Inaba et al. | 57/281 |
| 4,145,868 | 3/1979 | Morita et al. | 57/268 |
| 4,351,494 | 9/1982 | Schippers et al. | 242/35.5 A |
| 4,418,525 | 12/1983 | Raasch | 57/268 X |
| 4,432,198 | 2/1984 | D'Agnolo | 57/276 |
| 4,473,997 | 10/1984 | Kawasaki et al. | 57/276 |
| 4,528,721 | 7/1985 | Hera | 57/281 X |
| 4,532,759 | 8/1985 | Bischofberger | 242/35.5 R X |
| 4,720,967 | 1/1988 | Guttler | 57/1 R X |
| 4,735,042 | 4/1988 | Igel | 104/91 X |

FOREIGN PATENT DOCUMENTS

| | | |
|---|---|---|
| 148129 | 7/1985 | European Pat. Off. . |
| 3144853 | 6/1982 | Fed. Rep. of Germany . |
| 60-67373 | 4/1985 | Japan . |
| 60-71469 | 4/1985 | Japan . |
| 60-82573 | 5/1985 | Japan . |

*Primary Examiner*—John Petrakes
*Attorney, Agent, or Firm*—Michael N. Meller

[57] ABSTRACT

A system for controlling the displacement motion of a carriage working machine which is capable of displacing along a track arranged along ends of spinning machines installed in parallel as a group, wherein an automatic apparatus for carrying out a certain part of the process by these spinning machines is rigidly or detachably mounted on a carriage. In this system, when a spinning machine outputs a forecast signal to call the working machine, the forecast signal is registered in a registration table. After the working machine has arrived at a position on the track adjacent to the particular spinning machine, and it is confirmed that the particular spinning machine can accept the operation of the automatic apparatus of the working machine, then the automatic apparatus starts to carry out its operation. Thereafter, a particular spinning machine to which the operation of the automatic apparatus should be applied with the first priority is selected based upon data registered in the registration table, and the travel direction of the working machine is determined based upon the frame number of the above-mentioned particular spinning machine and the present position of the working machine. This selection and decision is logically made, according to respective programs, by a computer.

13 Claims, 11 Drawing Sheets

SYSTEM FOR CONTROLLING DISPLACEMENT OF CARRIAGE WORKING MACHINES

This application is a continuation of application Ser. No. 67,261, filed June 25, 1987, now abandoned.

BACKGROUND OF THE INVENTION

1. Technical Field

The present invention relates to a system for controlling the displacement of carriage working machine in a spinning mill wherein a plurality of spinning frames or roving frames are installed, this working machine being capable of traveling along end of respective groups of these spinning machines, while an automatic apparatus for carrying out a certain part of the process performed with these spinning machines is rigidly or detachably mounted thereon.

2. Description of the Related Art

In so-called modern spinning mills, automatic systems are used to realize, for example, a rational processing together with a reduction in labor costs, an increased production speed, and an up-grading of production efficiency, and it is well known that in a processing system utilizing automatic doffing for spinning machines such as roving frames or spinning frames, a processing system for automatically replacing exhausted roving bobbins with halfway exhausted roving bobbins, or for automatically replacing exhausted roving bobbins with full packaged roving bobbins respectively in spinning frames, is used. For example, an automatic doffing system is applied to the roving process (as shown in EP-A2-0148129) and also in the spinning process (as shown in US-A-4145868), an automatic system for replacing almost exhausted roving bobbins mounted on the respective back creels with the halfway exhausted roving bobbins mounted on the respective back creels of each side of the spinning frame, have been applied in recent years (as shown in US-A-4473997). The above-mentioned replacing of roving bobbins is hereinafter called "automatic switching". In such automatic doffing and automatic switching systems, it is usual to use a carriage which is capable of carrying a pair of automatic doffing apparatuses or automatic switching apparatuses to a position adjacent to an end of a spinning machine to which the operation of these automatic apparatuses is to be applied. However, this direction along the track thereof, and when a change in the travel direction at each terminal of this track becomes necessary, several problems including that of working efficiency must be solved under the present circumstances.

Another automatic system modified from the above-mentioned automatic doffing or switching system can be utilized in the spinning mill, that is, the automatic doffing apparatus or switching apparatus is built-in the above-mentioned carriage as one body. However, in this system, the automatic doffing apparatus is displaced together with the carriage along the spinning machine when the carriage is displaced to a position on the track adjacent to the end of the abovementioned spinning machine. In this modified system, the problem of the above-mentioned first sytem cannot be avoided.

The above-mentioned problems are hereinafter explained in more detail by a typical example of the automatic doffing system applied for a group of spinning frames.

As is well known, the operation of these spinning frames and the displacement of the carriage are absolutely independent, and the travel direction of the carriage can be changed at only both terminal ends of the travel path along this group of spinning frames.

For example, in the automatic doffing system applied to the spinning system disclosed in U.S. Pat. No. 4,145,868, since the automatic doffing apparatus, mounted on the carriage, must start the doffing operation after the carriage is displaced to a position adjacent to a spinning frame which has issued a signal requesting the doffing operation during the displacement of the carriage in one direction along a track laid adjacently along ends of the spinning frames, if the above-mentioned spinning frame is located at a downstream position which the carriage has passed on the track facing this spinning frame, the distance for displacing the carriage to the above-mentioned position on the track facing the spinning frame which is requesting the doffing operation becomes excessively large, because the travel direction of the carriage can only be changed at both end terminals of the track. In other words, the time needed to displace the carriage to the above-mentioned spinning machine becomes excessively long, so that it is impossible to avoid a delay in the starting time of the doffing operation of the above-mentioned spinning frame. Such a delayed operation of the doffing apparatus lowers the entire working efficiency of the automatic doffing system in the spinning room. Accordingly, this is the first problem to be solved.

Recently, there is a tendency whereby, in a group of spinning frames, several different types of spinning yarns having different yarn counts are simultaneously produced by the respective spinning frames, i.e., a system of simultaneously producing several yarns of different types on a small production scale is carried out. In such a condition, it is essential to start the doffing operation from a spinning frame taking a position at one side of the alignment of the spinning frames in the group, then at the next spinning frame taking a position adjacent to the above-mentioned first spinning frame, and then to the next spinning frame taking a position adjacent to the above-mentioned second spinning frame and so on. Accordingly, to avoid possible interference between doffing operations among these spinning frames, the package sizes of cops are stepwisely changed with respect to the spinning frames, so as to issue signals requesting a doffing operation in an order such that the doffing operation of a spinning frame can be started after the completion of the doffing operations of another spinning frame located at an adjacent upstream position with respect to the track of the working machine. However, in such a condition, it is necessary to determine the package size of cops in a condition smaller than the full package size. Therefore, inevitably, the number of doffing operations needed to carry out the operation of the group of spinning frames must be increased; in other words, the production efficiency of the group of spinning frames is lowered. This is the second serious problem of the conventional doffing system.

To solve this problem, the following system can be considered whereby the doffing operations of such spinning frames as a spinning frame producing coarse yarn, which needs comparative many doffing operations, may be carried out in order of priority. However, if the carriage provided with a doffing apparatus which can only change its travel direction at both terminal ends of the displacing track thereof is used, the timing for changing the travel directions is very restricted and thus such a doffing system is not practical. This is the third problem to be solved.

In addition to the above-mentioned problems the following problems have been recognized as serious. That is, in the conventional system, the working machine to operate the automatic doffing operation or switching operation is stopped by detecting a lit call lamp disposed in the end portion of each spinning frame, and then must wait for the switch ON of an indication lamp which indicates that the size of the product package has becomes full. Therefore, if such an indication lamp is broken or burned-out, or the ring rail of a spinning frame does not fall down to a position which is necessary to carry out the doffing operation, because of improper driving of this spinning frame, or it cannot be confirmed that the automatic apparatus is ready to carry out the operation because the ring rail does not fall down, or it is impossible to confirm whether or not the above-mentioned call lamp is lit, the carriage holding the automatic apparatus is thus forced to remain continuously at a position adjacent to the end of the spinning frame, and the efficiency of the operation of the automatic apparatus is lowered.

Like the above-mentioned doffing operation of the spinning frame, it is practical to use the carriage holding the automatic apparatus to carry out the doffing operation for roving frames. Therefore, in the roving process, problems similar to the above-mentioned problem in the doffing operation of the spinning frames must be confronted.

In the modified system utilizing such an automatic doffing or switching apparatus secured to the carriage, the same problem as in the above-mentioned system utilizing the automatic doffing or switching apparatus detectably mounted on the carriage cannot be avoided.

Accordingly, hereinafter for brevity, the roving frame and the spinning frame are referred to by one term "spinning machine", which means either one or both of the roving frame and the spinning frame, and the term "carriage working machine" is used to cover all the embodiments such as the above-mentioned carriage which functions to carry the automatic doffing apparatus or automatic switching apparatus, the above-mentioned automatic machine constructed as a carriage and the automatic doffing or switching apparatus rigidly mounted on this carriage.

SUMMARY OF THE INVENTION

It is an object of the present invention to provide a system for controlling the displacement of carriage working machines. In this system, which is applied to groups of spinning machines arranged in parallel to each other, a working machine can be displaced along the track parallel to ends of the spinning machines in each group thereof, and each spinning machine is provided with means for outputting a forecasting signal which requests the displacement of the working machine on the track and means for indicating a present position of this working machine on the track, which position is adjacent to a spinning machine where the operation of the automatic apparatus is being carried out. The latter means may be mounted on the working machine.

The above-mentioned first means is hereinafter referred to as the forecasting signal outputting means, and the second means is hereinafter referred to as an identification code outputting means.

The main control apparatus is utilized for one group of spinning machines.

This system is provided with a main control apparatus provided with two elements; the first of which is a means for selecting a spinning machine to which the above-mentioned operation of the working machine should be applied with a first order priority within the spinning machines on the basis of the forecasting signal output from the forecasting signal outputting means. The above-mentioned selected spinning machine is hereinafter referred to only as a particular spinning machine. The second element is a means for deciding the direction for displacing the working machine toward the particular spinning machine based upon the signal ouput from the above-mentioned identification-code outputting means and the signal output from the above-mentioned means for selecting the particular spinning machine. This means for selecting the particular spinning machine is hereinafter referred to as a selecting means, and the above-mentioned direction "in which the working machine is displaced" is hereinafter referred as the "travel direction".

This main control apparatus is further provided with a transmitter for transmitting a signal instructing the working machine as to its travel direction. In relation to this main control apparatus, the working machine is provided with a receiver for receiving the signal issued from this transmitter so that the carriage working machine can be displaced from the present working position to the next working position selected by the above-mentioned main control apparatus.

In the control system according to the present invention, after the working machine has arrived at the position on the track adjacent to the above-mentioned particular spinning machine, when the particular spinning machine reaches a condition such that the operation of the automatic apparatus is necessary, a calling signal is output, for example, a call lamp mounted thereon is lit, so that means for receiving this calling signal, such as a photo-cell, which is mounted on the working machine, receive this calling signal, and then the operation of the automatic apparatus can be started.

In addition to the above-mentioned elements of the main control apparatus there is provided a timer which detects and confirms that a predetermined time has passed from the time at which the working machine arrived at the predetermined position adjacent to the particular spinning machine; and an alarm buzzer, which issues an alarm sound if the above-mentioned calling signal is not received by the receiving means of the working machine. Therefore, possible damage to the efficiency of the working machine can be avoided.

According to the above-mentioned control system of the present invention, the position of each working machine is always monitored, the particular spinning frame which needs the operation of the automatic apparatus is selected by the above-mentioned selecting means at a pertinent timing, for example, at a time when the operation of the automatic apparatus to a spinning machine is completed, and this selecting means is actuated by a signal issued from the forecasting signal outputting means. The direction for displacing the working machine from the present position is decided by the information signal indicating the position of a spinning machine which needs the operation of the working machine in relation to the signal indicating a present position, and then the signal indicating the travel direction is transmitted to the working machine by way of the receiver, so that the working machine is displaced from the present position to the position where the next operation thereof must be carried out.

DESCRIPTION OF THE PREFERRED EMBODIMENTS

Figure 1:
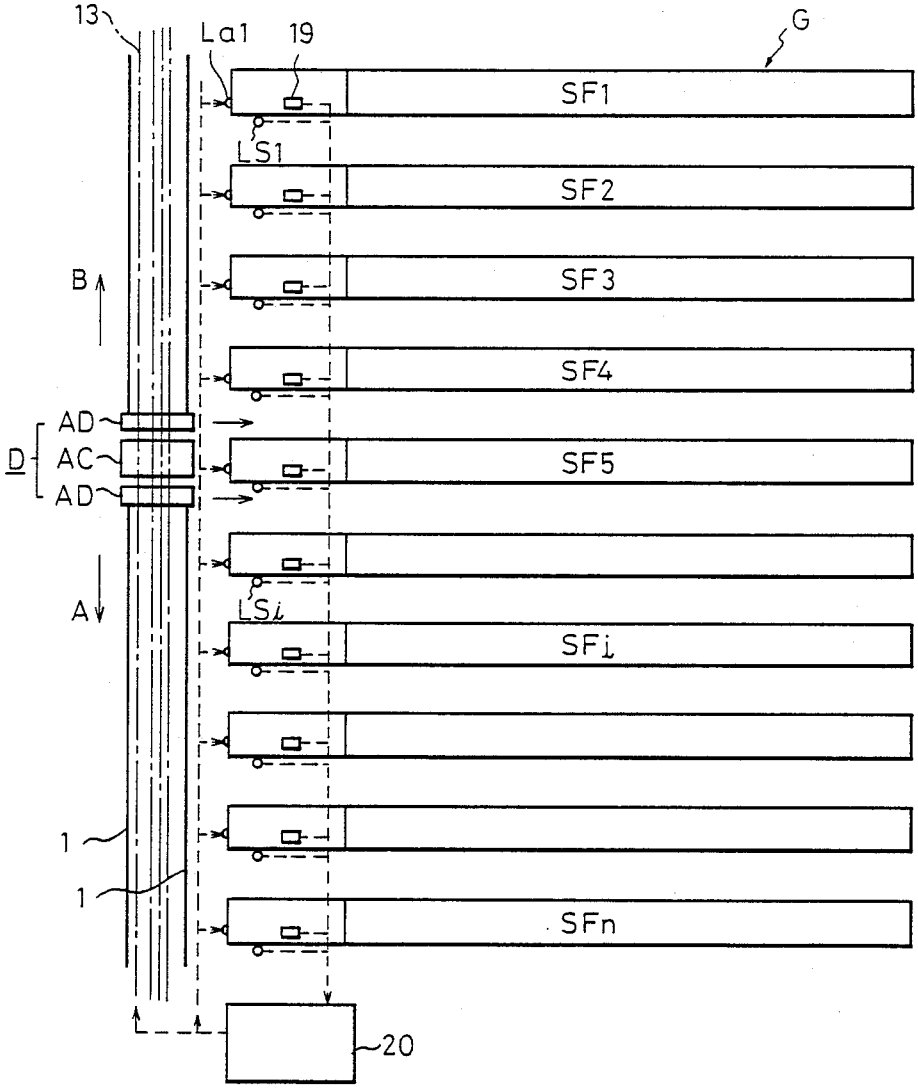
FIG. 1 indicates a relationship between a group of spinning frames and a working machine to which the control system according to the present invention is applied.

The construction and function of preferred embodiments of the present invention are hereinafter explained in detail with reference to the above-mentioned drawings, respectively. Referring to FIGS. 1–4, spinning frame SF1 through SFn are arranged in parallel in a spinning room so that a group (G) of spinning frames is formed. A pair of rails 1 are laid out along the ends of machine frames of the spinning frame group G. A working machine D comprises a carriage AC and a pair of automatic doffing apparatuses (hereinafter referred to as doffer AD), which are loaded on both sides of the carriage AC respectively in a manner as described hereinafter. Running wheels 2 of the carriage AC are placed on the rails 1 and driven by a driving motor M to move the carriage AC on the rails 1. On the carriage AC, a suspension rail 5 is mounted on each side of to support a driving wheel 3 and a driven wheel 4 of the doffer AD, and on one end of this rail, there is pivotably disposed a bridge rail 7 to be connected to a guide rail 6 arranged along the front faces of spinning frames FSi (i=1 to n), so that when the bridge rails 7 are rotated to a horizontal position collinear with rails 6, the doffers AD can be advanced along the front faces of the corresponding spinning frame from both sides of the carriage AC respectively, and at the time of completion of the doffing operation, the doffers AD can be loaded on the corresponding one of the suspension rails 5 disposed on both sides of the carriage AC. A limit switch LSb, which is capable of engaging the bridge rail 7 at the time when the bridge rail 7 is pivoted so as to connect with the guide rail 6, is disposed on the front face of the carriage AC, so that the connection of the bridge rail 7 to the guide rail 6 can be confirmed. A control box 8 having, in the interior thereof, an operation controller PC, such as a receiver described hereinafter, is disposed above the carriage AC. A shoe 14 is disposed at a top end of an arm 15 secured to the control box, and trolley wires 10 through 12 for supplying AC current and a signal transmission line 13 are suspended from a ceiling of the spinning mill. The shoe 14 is provided with sliding contacts which are in contact with the above-mentioned trolley wires 10 through 12 so that the motor M of the carriage AC is capable of receiving electricity through these trolley wires 10–12, while the shoe 14 is provided with another sliding contact which is in contact with the signal transmission line 13 so that the control box 8 is capable of receiving a signal indicating the direction of displacement of the working machine D, which will be explained in detail later. Light receivers 16 and 17 are mounted on the side face of the control box 8 so that they can confront a call lamp La1 for the working machine D and a full package indication Lamp La2 for the working machine D, which are disposed on the spinning frame SFi.

In each spinning frame SFi, a limit switch LS1, which is an element of the means for indicating the present position of the working machine, is mounted on an end of the guide rail 6, and when the bridge rail 7 is connected with the guide rail 6 of the spinning frame SFi, the limit switch LS1 is actuated to issue a signal indicating that the spinning frame SFi has reached a full yarn package condition, and to light the full package indication lamp La2. In other words, this signal is utilized as an identification-code outputting means indicating to which spinning frame in the group G of spinning frames the carriage AC is connected. In each spinning frame SFi, a known automatic counter 18 connected to a front roller (not shown) is disposed as a means for counting the quantity of produced yarn by which the length of produced yarn in a package can be measured. Critical conditions for actuating the automatic counter, to issue a signal for previously notifying that the size of the yarn package is approaching the full size, and to issue a signal indicating that the size of the yarn package is now full, are set in this auto-counter 18. The above-mentioned first condition may be set by a time which corresponds to a 90% completion of the condition wherein the size of the yarn package reaches the full size, and the above-mentioned first critical condition functions to issue the forecasting signal requesting the displacement of the working machine D, while the above-mentioned second critical condition functions to light the full package indication lamp La2 so as to actuate the doffers AD. The signals from the automatic counter 18 and the signal from the limit switch LS1 are received in a sequential controller 19 disposed in each spinning frame. A so-called programmable controller such as a known microcomputer, which is capable of performing various sequential operations, may be utilized as the above-mentioned sequential controller 19. This sequential controller (first controller) 19 is connected to another sequential controller (hereinafter referred to as "second controller") 21 incorporated in a main controller 20 disposed in the end portion of the group G formed by the spinning frames, so that transmission of signal data and instructions can be performed.

Figure 2:
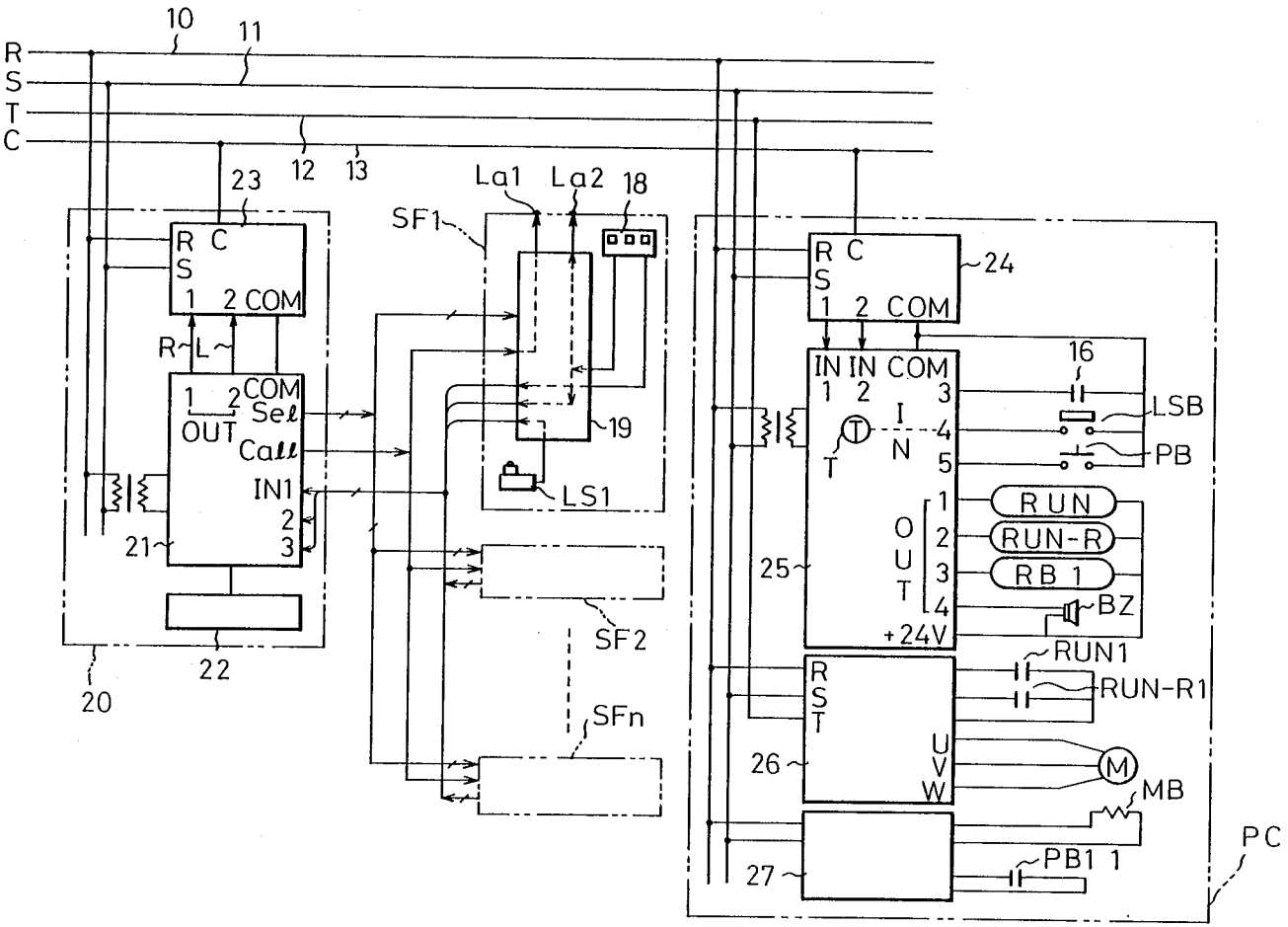
FIG. 2 is a circuit diagram indicating the system for controlling the displacement of a carriage working machine according to the present invention.
Figure 3:
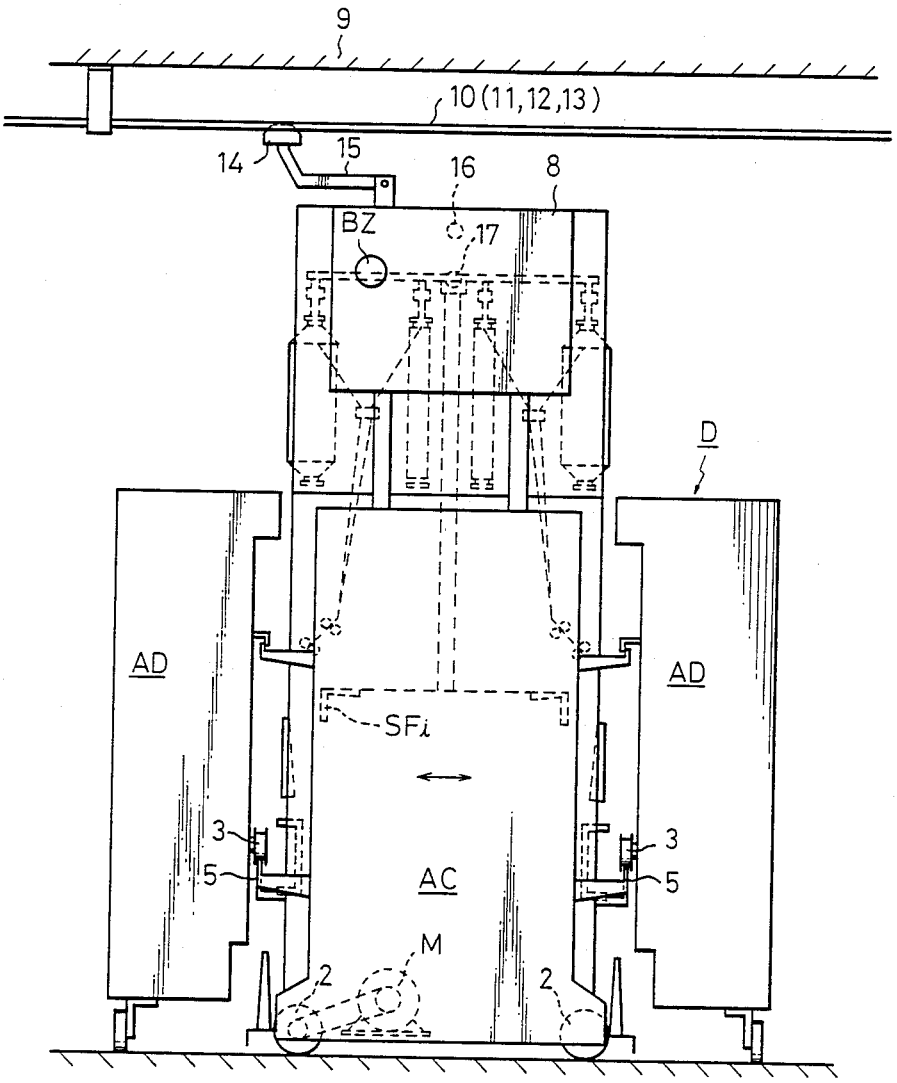
FIG. 3 is a front view of a carriage working machine provided with elements of the control system according to the present invention.
Figure 4:
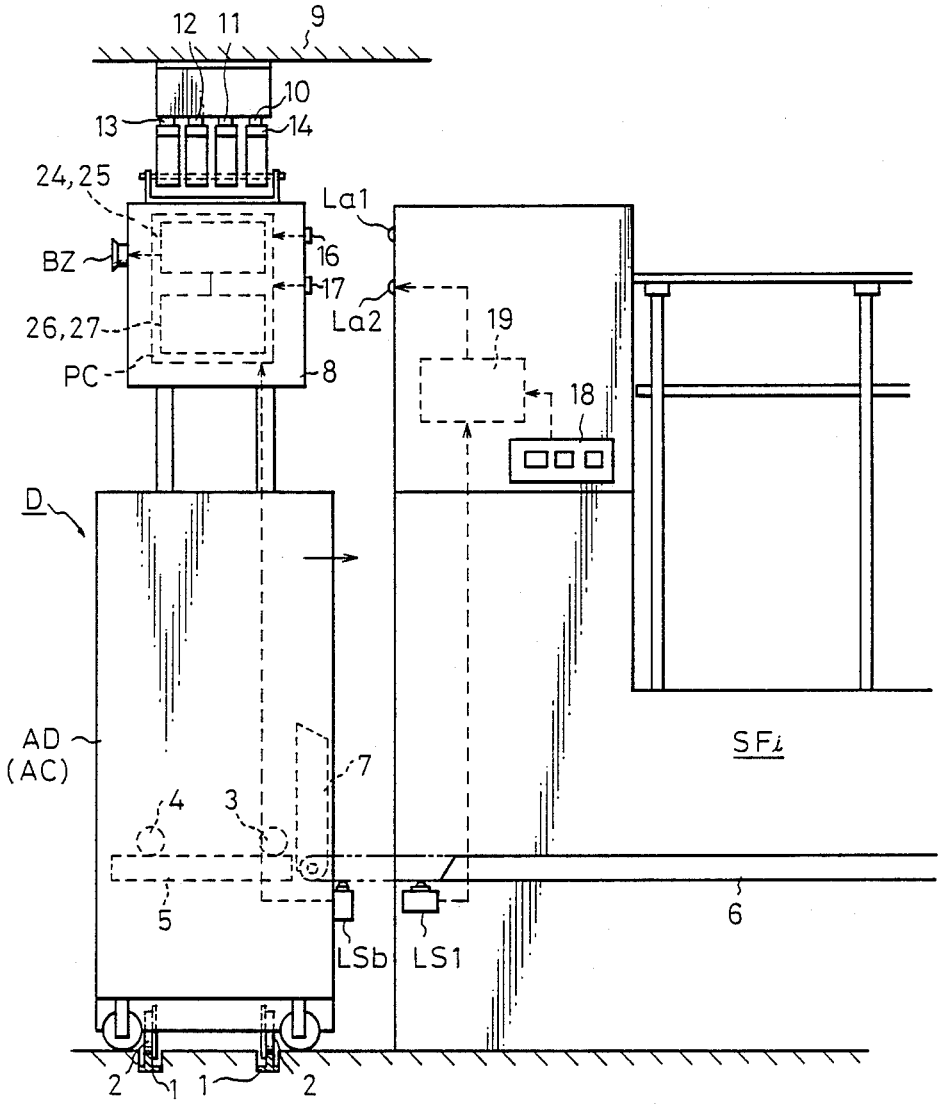
FIG. 4 is a side view of the carriage working machine shown in FIG. 3.
Figure 5A:
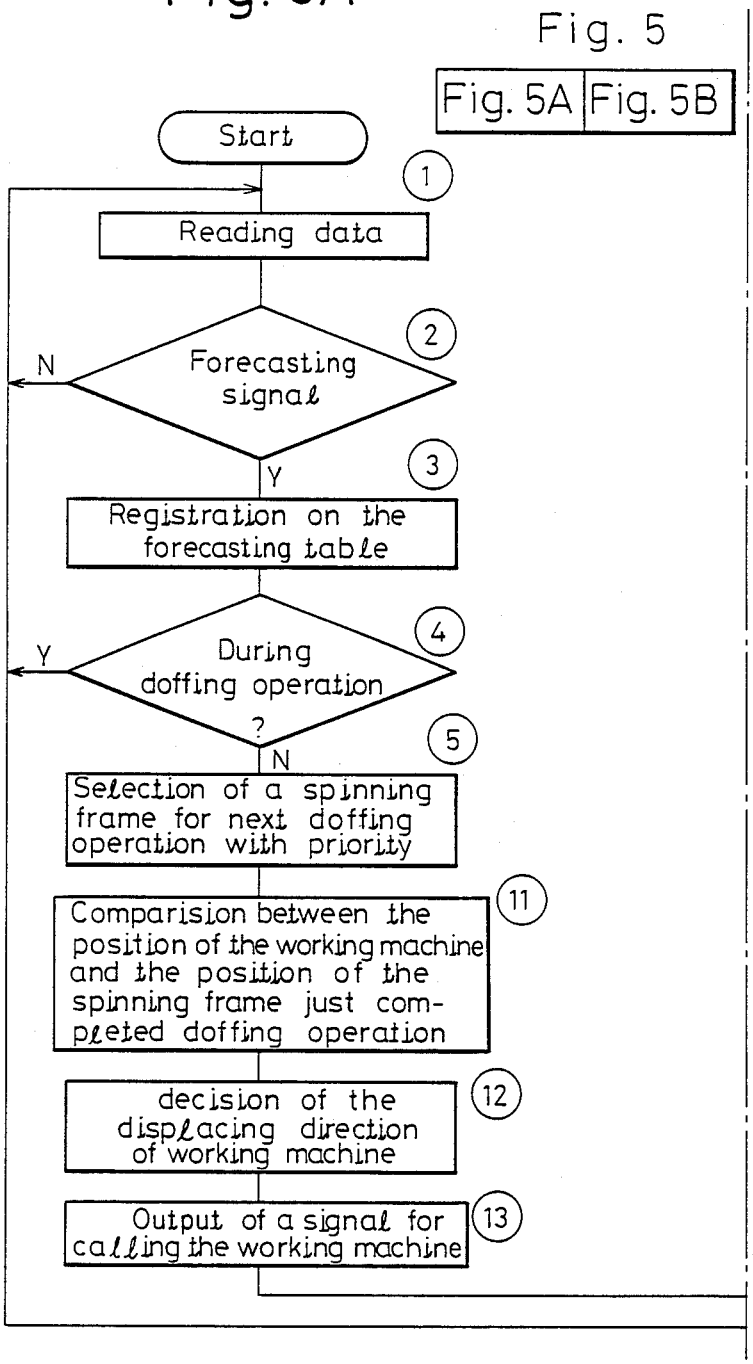
FIGS. 5A, 5B and 6 are parts of a flow chart of the action of the main control apparatus utilized in the control system according to the present invention.
Figure 5B:
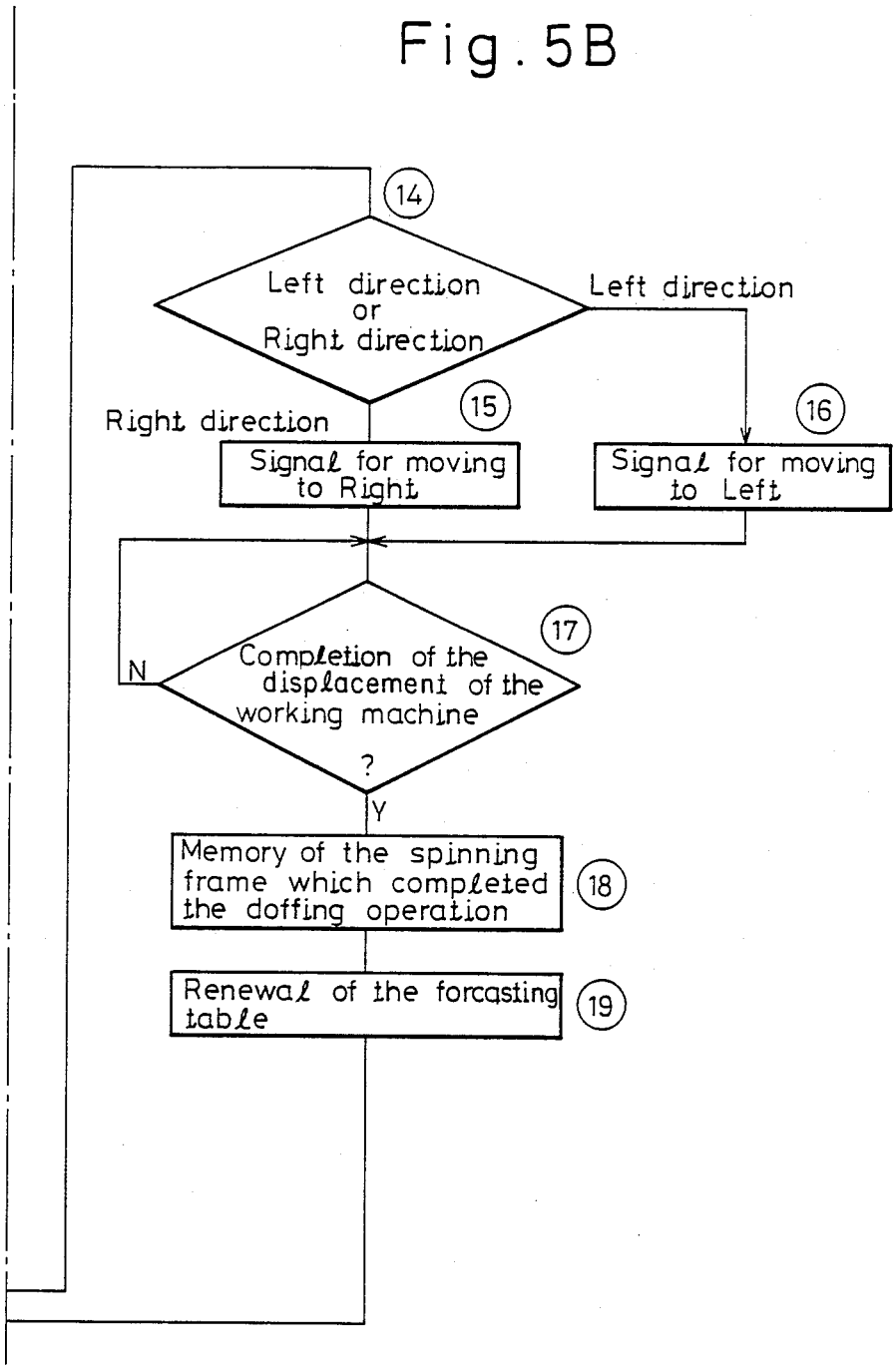
Figure 6:
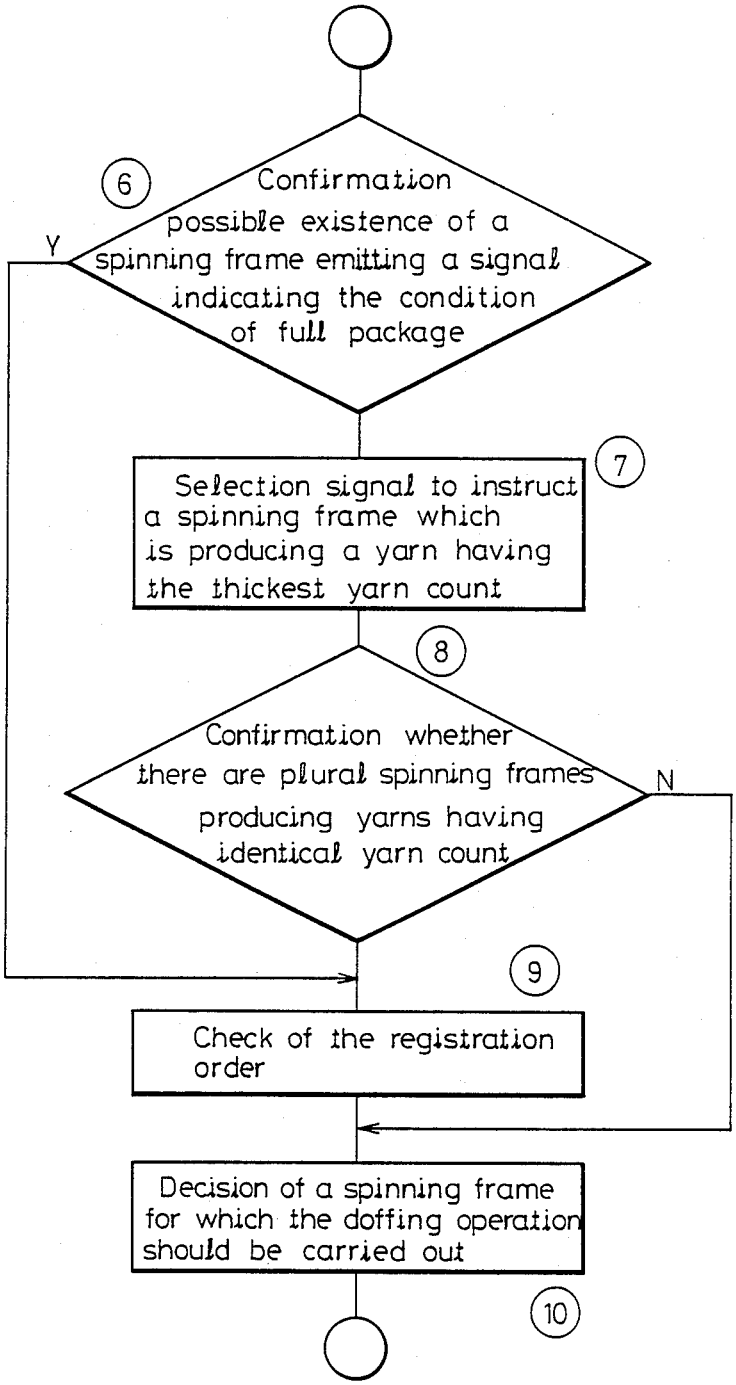
Figure 9:
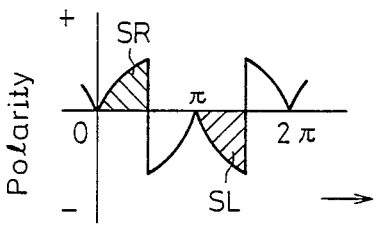
FIG. 9 indicates a wave signal which controls the travel direction of the working machine.

As shown in FIG. 2, the main controller 20 comprises a keyboard 22, a second controller 21, and a transmitter 23 of a transmitting unit, and a program corresponding to the flow charts shown in FIGS. 5A, 5B and 6 is stored in the second controller 21. The signals of the automatic counter 18 and limit switch LS1, through the first controller 19 of each spinning frame, and the signal of the keyboard 22, are input to the input terminal of the second controller 21. From the output terminal of the second controller 21, a selection signal Sel which indicates a spinning frame SFi which needs the operation of the automatic apparatus, and a call signal which requests the displacement of the working machine D toward the particular spinning machine, to which the operation of the automatic apparatus should be necessary with the first priority in order, are output. The call signal is input to the first controller 19 and the working machine D through the transmitter 23, as hereinafter explained, and a signal for instructing the working machine D to travel in either one of the travel directions (right or left) is issued. When the working machine call signal is issued, the first controller 19 lights the call lamp La1. The transmitter 23 transmits the left travel signal L or right travel signal R from the second controller 21 to a receiver 24, which is an element of a controller PC in the control box 8 mounted on the carriage AC, by using two of the above-mentioned alternating current power trolley wires 10 through 12 and one signal line 13. Namely, alternating current wave forms differing in phase are formed from the alternating current power wave by a phase inverter, and the alternating current wave forms are subjected to polarity separation and wave form separation to obtain signal wave forms differing in polarity and phase as shown in FIG. 9. The wave form SR and wave form SL of these signal wave forms are made to correspond to left and right travel signals L and R, respectively, and when the left-moving or right-moving signal is issued, the corresponding signal wave form SL or SR is carried on the signal line 13.

Figure 7A:
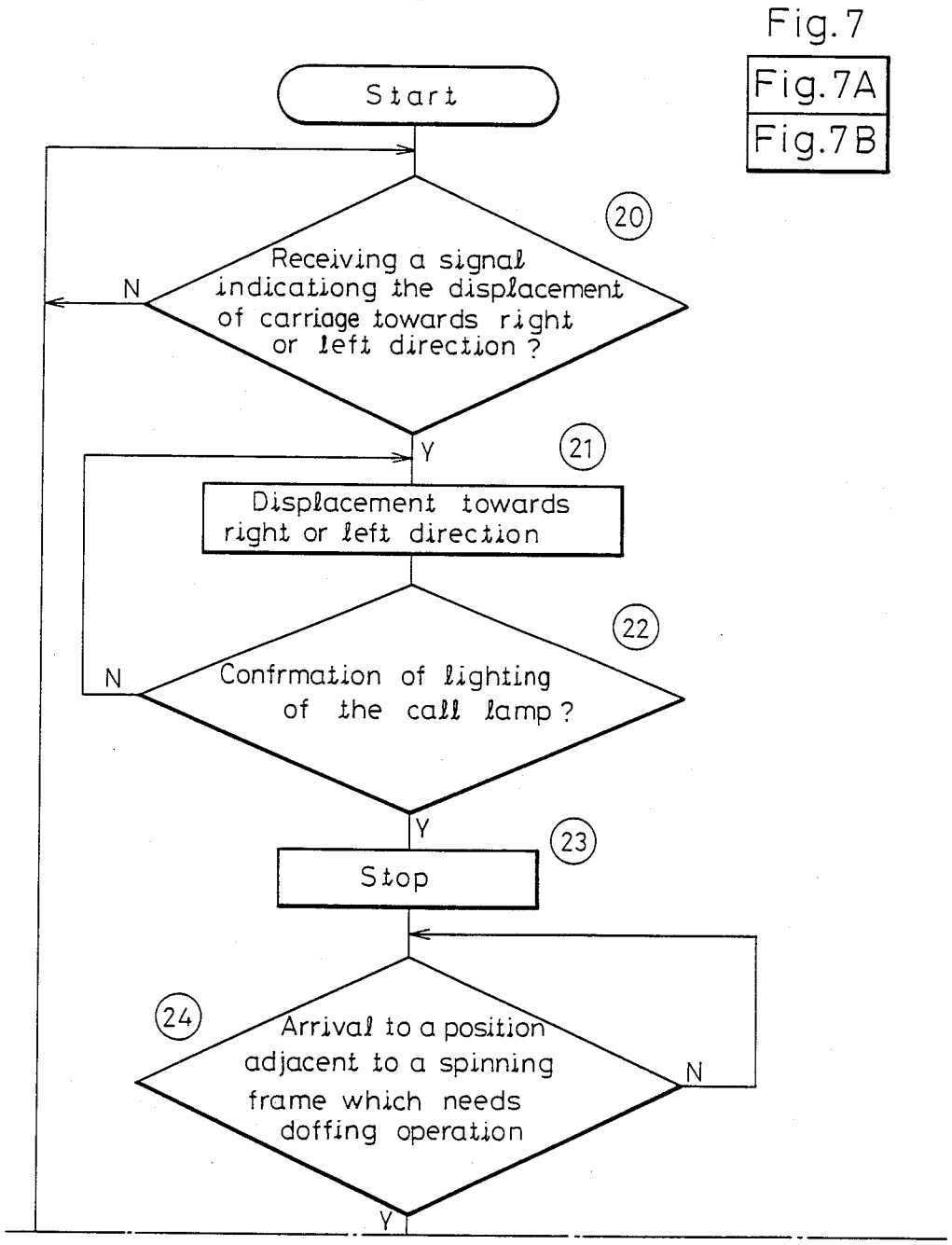
FIGS. 7A, 7B, are parts of a flow chart of the control system according to the present invention.
Figure 7B:
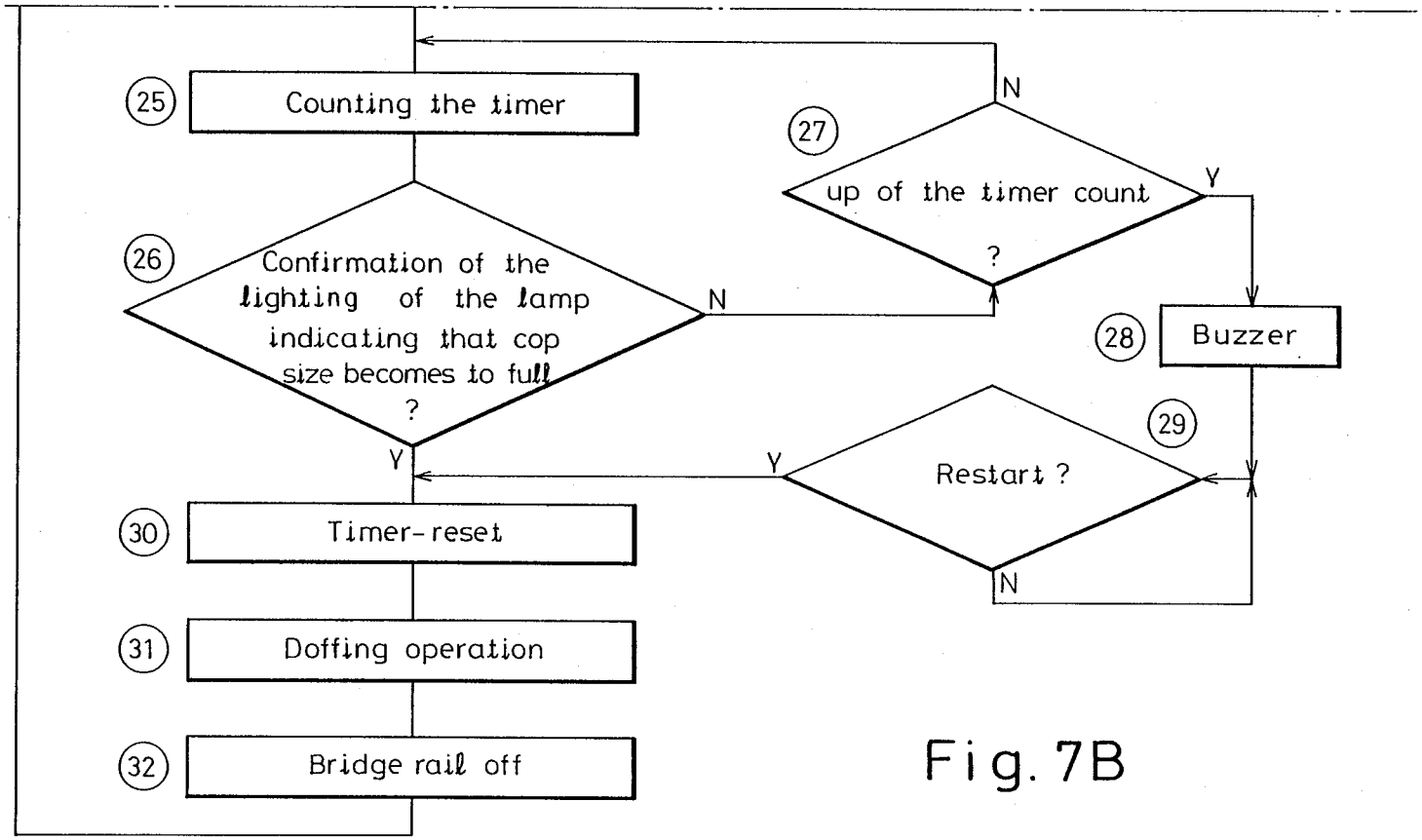

The working machine controller PC, in the control box 8, comprises the above-mentioned receiver 24 of the transmitting unit, a third sequential controller (third controller) 25, a general-purpose inverter 26 and a braking power unit 27. The receiver 24 checks the phase and polarity of the signal wave form from the transmitter 23 and determines whether the wave form SR or the wave form SL is transmitted, and the receiver 24 outputs the right or left travel signal R or L corresponding to the determined signal wave form to the third controller 25. Relays RUN and RUN-R, which actuate the driving motor M of the carriage AC, a braking relay RB1, and an alarm buzzer BZ are connected to the output terminal of the third controller 25, and the input terminal of the third controller 25 is connected so that the right and left travel signals R and L are input from the receiver 24 respectively. Furthermore, a contact of the light receiver 16, a contact of a limit switch LSb for controlling an inner timer T within the third controller 25, and a push button switch PB for emitting a signal stopping the buzzer BZ are connected to the input side of the third controller 25. A program shown in the flow charts of FIGS. 7A and 7B is stored in the third controller 25. The inner timer T sets a predetermined standby time after the limit switch LFb is pivoted ON (that is, after the bridge rail 7 is pivoted and brought into contact with the machine stand), and in the case where the spinning operation is forced to stop so as to carry out the doffing operation, this standby time is identical to a time needed for stopping the rotation of the main motor of the spinning frame concerned after the working machine D is displaced to the position for connecting the bridge rail 7 thereof to the ring rail of the spinning frame, bringing down the ring rail and creating the condition whereby the doffing operation can be carried out. In other cases, the standby time is set for a period from the time of lighting of the call lamp La1 to the time of lighting of the full bobbin lamp La2, which is preliminarily determined according to the spinning condition. The driving motor M and normally opened contacts RUN1 and RUN-R1 of the relays RUN and RUN-R are connected to the inverter 26. A brake MB and a contact RB1-1 of a braking relay RB1 are connected to the braking power unit 27. When the right travel signal R is received, the relays RUN and RUN-R are turned ON and the driving motor M is rotated in the normal direction to move the working machine D to the right, and when the left-travel signal L is received, only the relay RUN is turned ON to move the working machine D to the left.

Figure 8:
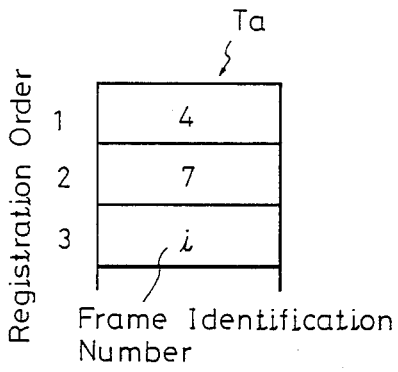
FIG. 8 is a drawing for explaining a table for previously indicating a particular spinning frame (or roving frame) which will complete the operation to produce full packaged cops (roving bobbins)

The operation will now be described with reference to FIG. 2 and the flow charts of FIGS. 5A through 7B. The case where, in the spinning frame group G, several yarns having different yarn counts are produced in the respective spinning frames SFi and yarn count numbers are stored in the second controller 21 in a condition such that they correspond to the identification numbers of the respective spinning frames SFi is described. When the spinning operation is being carried out in the spinning frame group G and the doffing operation by the doffing apparatus AD is being carried out for a certain spinning frame (for example, the spinning frame SF5), spinning data from other spinning frames is received at step 1 of the flow chart. If the forecast signal indicating the timing that the size of the yarn package has reached a predetermined size is output from the automatic counter 18, which functions to issue the forecasting signal, in another spinning frame, the frame number of this spinning frame is registered in the table Ta for registration in the second controller 21 shown in FIG. 8 at steps 2 and 3, and simultaneously, the frame number of a spinning frame outputting the signal, indicating that the size of the yarn package has reached a predetermined size, is stored in a predetermined memory area in the second controller 21. At step 4, it is determined whether or not the doffing operation is being carried out, and data from other spinning frames is read in sequence before completion of the doffing operation in the spinning frame SF5, and is added to the table Ta. When the doffing operation is completed, this condition is confirmed by turning-off the limit switch LS1, and the routine goes to step 5 as the spinning frame selecting means for selecting the spinning frame for which the doffing operation should be next performed with priority. In the present embodiment, according to the flow chart shown in FIG. 6, the next spinning frame is selected in the order of registration in the table Ta and by the yarn number of a yarn which is produced at each spinning frame in the group G. Namely, at step 6, it is determined whether or not there is a spinning frame outputting the forecast signal, among the spinning frames registered in the table Ta. If such a spinning frame outputting the above-mentioned signal exists, the routine proceeds to step 9, and if such a spinning frame does not exist, a spinning frame which produces a yarn having a thickest yarn count is selected among the spinning frames registered in the table Ta at step 7. At step 8 it is determined whether or not another spinning frame exists, which is producing yarn having an identical count. If there are a plurality of spinning frames which are producing yarn having an identical yarn count, the routine proceeds to step 9 for checking the order of registration in the table Ta. Then, at step 10, it is determined that the preceding registered spinning frame (SF4 in the present embodiment) is the spinning frame for which the doffing operation should be next performed with priority in order. Then, at step 11, a position comparison is carried out based on the frame number of the spinning frame SF5 where the doffing operation is completed and the frame number of the spinning frame SF4 for which the doffing operation should be next performed. The data indicating the spinning frame where the doffing operation is completed has already been stored in the second controller 21 at step 18, which will be further explained later, by turning-on the limit switch LS1 by the bridge rail 7 at the doffing operation. In this embodiment, at step 12, it is decided that the travel direction is to the left. The system means for deciding the travel direction of the working machine D is constructed by these steps 11 and 12. Then, at step 13, the selection signal Sel and working machine calling signal are output to the first controller 19 from the second controller 21, and ôn receipt of the signals, the first controller 19 of the selected spinning frame SF4 lights the call lamp La1. Then, according to the decision of the direction of tavel of the working machine D at step 12, it is decided at step 14 whether the travel direction is to the left or to the right. Since the travel direction is to the left, the left travel signal L corresponding to the travel direction is ouput at step 16. In response to the left travel signal L, the transmitter 23 carries the signal wave form SL on the signal line 13 and transmits the signal wave form SL to the receiver 24. In the working machine D, when the signal wave form SL is transmitted to the receiver 24, the left travel signal L is input to the third controller 25, and at steps 20 and 21, only the relay RUN is turned ON and the contact RUN1 is closd to displace the working machine D to the left. Note, if the right travel signal R is input, the third controller 25 turns ON the relays RUN and RUN-R to close the relay contacts RUN1 and RUN-R1 and displace the working machine D to the right. When the working machine D thus moves to the left (in direction B in FIG. 1) and the call lamp La1, which was lit by the first controller 19 at the above-mentioned step 13, is confirmed by the light receiver 16 at step 22, the relay RUN is turned OFF at step 23 and the relay RB 1 is turned ON to turn ON the contact RB1 and actuate the brake MB, thereby the driving motor M is braked and stopped. When the driving motor M is stopped, the bridge rail 7 of the carriage AC is pivoted to connect with the guide rail 6 and the limit switch LSb is turned ON by the arrival of the bridge rail 7 at the connection position and at step 24, therefore, the arrival of the working machine D at the working position can be confirmed, and at step 25, the inner timer T of the third controller 25 starts counter. Simultaneously, the limit switch LS1 of the spinning frame SF4 is turned ON, and at step 17 of the main controller 20, it is determined that the working machine D has arrived at the spinning frame for which the doffing operation should be next performed with priority in order, and at step 18, the frame number of this spinning frame is stored as the spinning frame where the doffing operation is now being performed. At step 19, the frame number of this spinning frame undergoing the doffing operation is erased from the table Ta to effect renewal of the registration data. In the spinning frame which the working machine D has reached, even in cases where the size of the yarn package has become full or is almost full, the lamp La2, which indicates the condition for now requiring the doffing operation, is lit, and if this lighting is confirmed by the light receiver 17 at step 26 in the working machine D before the count of the inner timer T is completed, the inner timer T is reset at step 30. Then, at steps 31 and 32, the doffing apparatuses AD on both sides mounted on the carriage AC are started to effect the doffing operation. After completion of the doffing operation, the bridge rail 7 is disconnected from the guide rail 6 and the working machine D waits for the issue of the left or right travel signal. In the case where lighting of the full bobbin lamp La2 is not confirmed within the time set by the inner timer T, the inner timer T counts up at step 27 and it is determined that the signal indicating the condition that the size of yarn package has become full is not confirmed in spite of the arrival of the working machine D at the working position at the spinning frame which requires the doffing operation, and the buzzer BZ is actuated at step 28 to inform a worker that the control system does not work correctly. At step 29, a re-start switch (not shown) is turned ON and the working machine D waits for the output of an instruction signal. In the abovementioned manner, the main controller 20 repeats the operations of steps 1 through 19, and the operations of steps 20 through 32 are repeated in the working machine controller PC. Accordingly, when the doffing operation is completed in the spinning frame SF5 in FIG. 1, whether the spinning frame for which the doffing operation should be then performed is SF4 or SF7, the working machine D is capable of traveling directly to the intended spinning frame from the spinning frame where the doffing operation has been completed. In this embodiment, in the same period of production, the doffing operation can be carried out with priority in order to a spinning frame which produces yarn having a thicker yarn count in comparison with the spinning frame producing yarn having a thinner yarn count, because the former spinning frame needs more frequent doffing operations compared with the latter spinning frame. Consequently, the working frequency of the doffing operation at all spinning frames in the group G can be raised.

In the above-mentioned embodiment, the control system applied to the group of spinning frames differing in the yarn counts of the products has been explained. However, the following modifications of this embodiment can be applied in practice. A selection of the spinning frame which has a priority for the doffing operation after completion of the doffing operation of a certain spinning frame can be made. That is, the selection may be made based upon the time remaining which is needed to create a condition that the size of the yarn package becomes full, in combination with the yarn counts of the products, in the spinning frames of which the identification numbers have been registered in the above-mentioned table. In addition to the above-mentioned selection method, a modification can be applied whereby the order of priority for carrying out the doffing operation regarding the above-mentioned spinning frames registered in the table is provisionally determined, and the time necessary to displace the working machine D from the present position where the doffing operation is carried out at a certain spinning frame to the position beside the particular spinning machine, and the time needed to complete this doffing operation, are further considered so that a pertinent spinning frame, to which the doffing operation will be applied next, can be selected, whereby any waste of time due to a possible stoppage of the spinning frames can be avoided.

As a modification of the above-mentioned second modification, a selection system can be applied whereby even if a certain spinning frame has to stop the spinning operation, the time of such a spinning operation stoppage can be restricted to an acceptably small time. The above-mentioned second modification can be further modified on this point.

On the other hand, in a case such that the yarn count of all products by the spinning frames in the group G is identical, the order of priority for the doffing operation can be followed is the order in which the spinning frames registered in the above-mentioned registration table. In such a condition, the timing of the condition wherein the size of the yarn package reaches a predetermined condition for outputting the forecast signal is monitored by the auto-counter in each spinning frame, so that a signal indicating that the size of the yarn package has reached the above-mentioned predetermined condition is transmitted to the sequential control device (the first controller). However, instead of the auto-counter, a modification can be applied such that a pulse signal generator which outputs a pulse signal each time a predetermined length of yarn is produced is connected to a front roller of each spinning frame, and the output of this pulse signal generator is input to a micro-computer comprising a CPU, ROM and RAM, which is utilized instead of the first controller, whereby the micro-computer counts the pulse signal and when the count reaches a predetermined value, a signal indicating that the size of the yarn package has reached the above-mentioned predetermined condition is transmitted to the second controller. Further, the following modification can be applied; that is, in the above-mentioned basic embodiment and modified embodiment, the working machine D is instructed as to its travel direction while the signal for calling the working machine is issued independently from the above-mentioned direction instruction. However, instead of applying the system mentioned above, a modification can be applied whereby the instruction signal indicating the travel direction and the travel distance is applied to the control device of the working machine D so that the working machine D is displaced toward the spinning frame which has priority for the next doffing operation.

As already explained, the present invention can be effectively applied to the operation for switching roving bubbins in the spinning frames of the group G.

Figure 10:
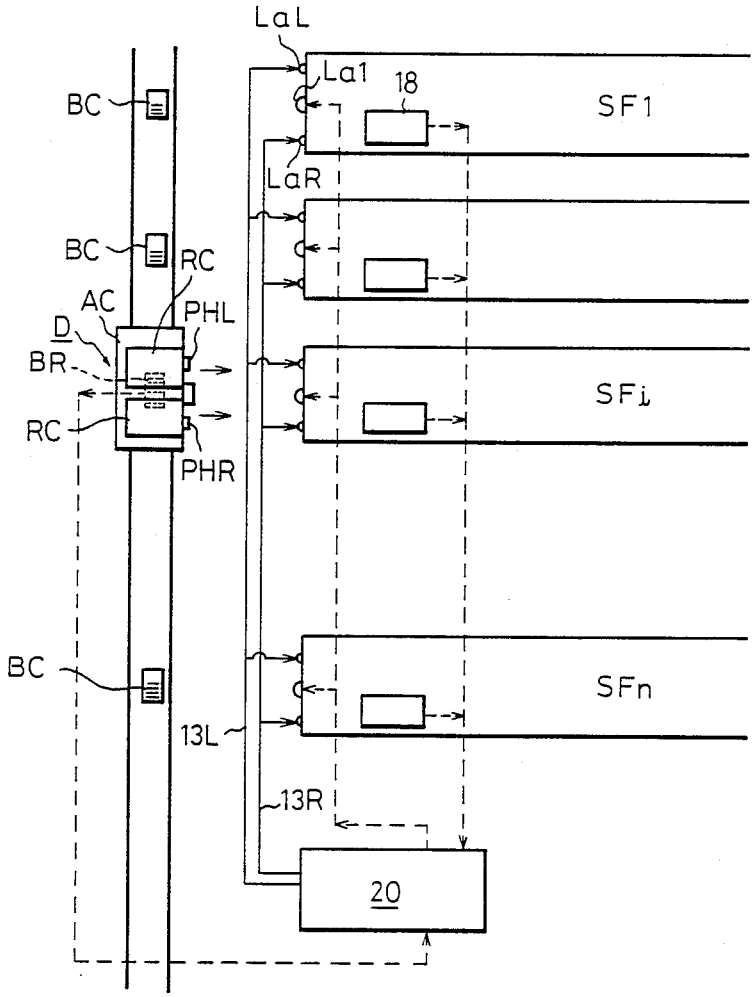
FIG. 10 indicates a circuit diagram of the control system according to the present invention which is applied to an apparatus for switching roving bobbins in a spinning frame.

Referring to FIG. 10, an embodiment wherein the present invention is applied to as roving bobbin switching apparatus as disclosed in U.S. Pat. No. 4,473,997 will now be described. In this embodiment, the carriage AC of the working machine D carries a pair of roving bobbin switching apparatuses RC for switching a front row and rear rows of roving bobbins supported by the respective creels arranged in two rows on both sides of the spinning frame. The switching apparatuses are mounted on both sides of the carriage AC. A transmitter 23*a* in the main controller 20 comprises a pair of signal lines 13L and 13R for left and right travel signals, in combination with a pair of left and right indicating lamps LaL and LaR disposed on the end of the machine frame of each spinning frame SFi. Note, the light receiver disposed on the working machine D comprises light receiving elements PhL and PhR for detecting left and right travel signals respectively, which confront the indicating lamps LaL and LaR. These light receiving elements PhL and PhR for are electrically connected to the working machine controller, so that when lighting of the respective indicating lamp is detected, the working machine D is displaced to the right or to the left. The means for outputting the position signal of the working machine comprises the bar code reader BR disposed in the carriage AC and a frame number identification bar code BC arranged on the track, facing the corresponding spinning frame SFi. The frame number read from the bar code BC is transmitted to the main controller 20. A means for reading the supplied quantity of roving is connected to a back roller (not shown). This means is a counter which measures the length of a roving supplied from the roving bobbin supported by the creel of the spinning frame. This counter functions to output the forecast signal to call the working machine and also to output a signal to actuate the switching apparatus. As in the above-mentioned first embodiment, the above-mentioned forecast signal is registered in the registration table disposed in the main control device 20. The displacement of the working machine D and successive motions of the switching apparatus are carried out in a similar control manner as in the embodiment shown in FIGS. 1–9.

As is apparent from the above description, in the present invention, since the signal indicating the present position of the working machine and the forecast signal requesting the displacement of the working machine are input to the main control apparatus, a particular spinning machine, to which the operation of the automatic apparatus of the working machine should be applied first in the priority order, is selected based upon the above-mentioned forecast signal and the signal indicating the present position of the working machine is then decided, and thereafter, the travel direction is transmitted to the working machine with a predetermined timing. Therefore, the working machine travel directly to the particular spinning machine, instead of continuously traveling in a direction in which the working machine was directed in the previous stage. Accordingly, if the system for controlling displacement of the present invention is compared with the conventional system, wherein the travel direction of the working machine can be changed only at either of the terminals of the track, and therefore, when a spinning machine which is located at an upstream position on the track with respect to the present position of the working machine ouputs a signal calling the working machine, the working machine is first displaced to a downstream terminal of the track and then the travel direction thereof is changed to the opposite direction and thereafter the working machine is displaced to the spinning machine which output the calling signal, it is quite clear that the time needed to displace the working machine from the present position to the position adjacent to the particular spinning machine can be remarkably reduced compared to the time needed for carrying out this operation by the conventional system. In addition to saving time, since the travel direction of the working machine can be flexibly changed as mentioned above, even in a condition whereby several kinds of yarns having different yarn counts are produced by spinning frames which form a group, the timing for changing the travel direction of the working machine provided with an automatic apparatus such as the automatic doffing apparatus is not restricted, and therefore, a very effective and practical operation of the automatic apparatus of the working machine can be carried out.

Moreover, in the present invention, regarding the operation of the automatic apparatus, even if the working machine arrives at a working position on the track adjacent to the particular spinning frame to which the operation by the automatic apparatus of the working machine should be applied, if the lamp, which emits a signal indicating a condition that the productivity condition has reached a predetermined condition which requires the operation by the automatic apparatus of the working machine, is burnt-out, or the operation by the automatic apparatus of the working machine at the spinning machine is not allowed, an alarm indicating such a problem is sounded, and therefore, such a problem can be quickly discovered by the operator. Therefore, this particular action can prevent a possible lowering of the working efficiency of the working machine and the spinning machine due to an unusual stoppage of the machines.

We claim:

1. A system for controlling the displacement of a working machine along a track arranged along ends of a plurality of spinning machines installed in parallel, said working machine comprising a carriage and automatic apparatus mounted on said carriage, said automatic apparatus performing an operation on said spinning frames, comprising:

means for outputting a forecast signal requesting the displacement of said working machine which is disposed on each spinning machine, means for indicating a present position of said working machine on said track, which position is adjacent to a spinning machine where the operation of said automatic apparatus is being carried out, said means for indicating said present position being disposed on either each spinning machine or said working machine, a main control apparatus comprising means for selecting a particular spinning machine at which said operation of said automatic apparatus should be carried out next with priority based upon a signal output from said means for outputting a forecast signal, means for deciding a travel direction of said working machine based upon a signal indicating a frame number of a spinning machine, in relation to said corresponding position from said present position of said working machine, which is issued from said means for indicating a present position of said working machine and a signal indicating a frame number of said particular spinning machine, which is issued from said means for selecting a particular spinning machine, and a transmitter for transmitting a signal instructing said working machine as to its travel direction, a control box disposed on said working machine, said control box being provided with a receiver for receiving said instruction signal issued from said transmitter of said main control apparatus so that said working machine is displaced toward said particular spinning machine upon receiving said instruction signal at said receiver, whereby said working machine can be displaced toward said particular spinning machine direct from said present position of said working machine.

2. A system for controlling the displacement of a working machine according to claim 1, further comprising:

first means for outputting a signal to actuate the operation of said automatic apparatus on said working machine, after said working machine has arrived at said position adjacent to said particular spinning machine, and second means for receiving a signal output from said first means, said first means being disposed on each spinning machine and said second means being disposed on said working machine.

3. A system for controlling the displacement of a working machine according to claim 2, wherein said control box is provided with a timer for detecting a time immediately after said working machine has arrived at a position on said track adjacent to said particular spinning machine, and a buzzer which outputs a call sound if said means for outputting a signal to actuate the operation of said automatic apparatus does not output said signal.

4. A system for controlling the displacement of a working machine according to claim 1, wherein each spinning frame has a front roller, said automatic apparatus of said working machine is an automatic doffing apparatus applicable to said spinning machine, and said forecast signal outputting means is an auto-counter connected to said front roller of each spinning machine which is capable of measuring a total quantity of product made by said spinning machine, said auto counter outputting said forecast signal at a predetermined time before a size of a product package reaches a full size.

5. A system for controlling the displacement of a working machine according to claim 1, wherein each spinning frame has a back roller, said automatic apparatus of said working machine is an automatic apparatus for switching roving bobbins for said spinning frame, and said forecast signal outputting means is a counter connected to said back roller of each spinning frame, which is capable of measuring a total length of roving supplied to said spinning frame, said counter outputting said forecast signal at a time immediately after said counter has detected that a predetermined length of roving has been supplied into said spinning frame.

6. A system for controlling the displacement of a working machine according to claim 5, wherein said automatic switching apparatus comprises means for switching the almost exhausted roving bobbins supported by front creels of said spinning frame in place of the full packaged roving bobbins prepared at a position adjacent to said spinning frame, after switching almost halfway exhausted roving bobbins supported by said front creels for almost exhausted roving bobbins supported by back creels corresponding to said front creels respectively.

7. A system for controlling the displacement of a working machine according to claim 1, wherein said automatic switching apparatus comprises means for switching the almost half of the exhausted roving bobbins supported by front creels of said spinnings frame in place of the almost exhausted roving bobbins supported by back creels corresponding to said front creels of said spinning frame, respectively.

8. A system of controlling the displacement of a working machine according to claim 1, wherein said means for selecting said particular spinning machine comprises a forecasting table for registering the frame number of spinning machines which have been indicated by said forecasting signals, in order of input thereof, and means for checking said registration order so that said particular spinning machine can be selected.

9. A system for controlling the displacement of a working machine according to claim 1, wherein said transmitter comprises means for outputting a plurality of signal-wave forms having a different polarity and phase from each other in response to a wave form of alternating electric current whereby a wave form signal corresponding to the travel direction of said working machine is selectively transmitted by a transmission line, and said receiver comprises means for discriminating the phase and polarity of said transmitted wave form signal whereby only the signal indicating the travel direction for said working machine is received.

10. A system for controlling the displacement of a working machine according to claim 1, wherein said means for indicating a present position of said working machine is a limit switch which is actuated by said working machine when said working machine arrives at a position on said track which is adjacent to a particular spinning track which issued said request signal.

11. A system for controlling the displacement of a working machine according to claim 1, wherein said means for indicating said present position of said working machine comprises bar codes indicating the identification frame numbers of each spinning machine, which are arrived at positions corresponding to the respective spinning machines, and a bar code reader disposed on said working machine so that said bar code reader is capable of identifying a particular spinning machine by reading the identification frame number of said bar codes.

12. A system for controlling the displacement of a working machine according to claim 1, wherein said automatic apparatus is detachably mounted on said carriage.

13. A system for controlling the displacement of a working machine according to claim 1, wherein said automatic apparatus is rigidly mounted on said carriage.

* * * * *